United States Patent [19]

Brown

[11] 4,345,454

[45] Aug. 24, 1982

[54] COMPENSATING WELL INSTRUMENT

[75] Inventor: Robert L. Brown, Buena Park, Calif.

[73] Assignee: AMF Incorporated, White Plains, N.Y.

[21] Appl. No.: 208,236

[22] Filed: Nov. 19, 1980

[51] Int. Cl.[3] ..... E21B 47/024

[52] U.S. Cl. ..... 73/1 E; 33/313

[58] Field of Search ..... 33/313, 304, 312; 73/1 E

[56] References Cited

U.S. PATENT DOCUMENTS

| | | | |
|---|---|---|---|
| 2,972,193 | 2/1961 | Young | 33/205 |
| 3,124,882 | 3/1964 | Black | 33/205.5 |
| 3,288,210 | 11/1966 | Bryant | 166/4 |
| 3,359,782 | 12/1967 | Van Bey | 73/1 E |
| 3,771,118 | 11/1973 | Lichte, Jr. et al. | 340/18 R |
| 3,791,043 | 2/1974 | Russell | 33/312 |
| 3,862,499 | 1/1975 | Isham et al. | 33/312 |
| 3,891,050 | 6/1975 | Kirkpatrick et al. | 181/102 |
| 4,040,189 | 8/1977 | LaCoste | 33/304 |
| 4,071,959 | 2/1978 | Russell et al. | 33/312 |

*Primary Examiner*—Jerry W. Myracle

*Attorney, Agent, or Firm*—William P. Green

[57] ABSTRACT

A well instrument which includes a probe adapted to be lowered into a well to sense the inclination of the well and the direction of that inclination, for use in steering a drill bit or surveying the well, is provided with mechanism for rotating the probe relative to a body of the tool about an axis extending longitudinally of the well in order to give an indication of and allow compensation for minor inaccuracies or offsets in the readouts produced by the sensing mechanism. The probe is desirably rotated alternately in opposite directions.

23 Claims, 5 Drawing Figures

COMPENSATING WELL INSTRUMENT

BACKGROUND OF THE INVENTION

This invention relates to improved well instruments for indicating or responding to changes in the inclination of a well.

In steering tools for directional drilling and in well surveying equipment, it is often desirable to utilize an instrument or tool which is lowered into a well and produces an indication or record of, or otherwise responds to, the inclination of the well and the direction of that inclination. The probe which is lowered into the well usually includes gravity actuated sensors which respond to changes in inclination relative to the true vertical, and direction responsive sensors such as magnetically actuated flux gates.

Over a period of time, instruments of this type may develop offsets or inaccuracies in the sensing means or other related elements, resulting in the introduction of corresponding errors into the readouts produced by the equipment. Such offsets may occur or vary at any time during the life of the instrument, and are completely unpredictable and very difficult to detect and measure.

SUMMARY OF THE INVENTION

The major purpose of the present invention is to provide means for detecting and/or compensating for offsets of this type in a well instrument, so that in spite of the development of inaccuracies in the sensing equipment a corrected output may be produced in which the effect of the inaccuracy is eliminated. This result is achieved by purposely rotating the sensing probe about an axis extending longitudinally of the well within which it is contained, to thereby sense any errors in the probe response in a series of different rotary positions of the probe. Variations which then occur in the indications of inclination and direction as the probe turns reveal the extent of any error and enable development of an extremely precise corrected output. In the preferred arrangement, the probe is turned alternately in opposite directions about a defined axis extending longitudinally of the well, desirably turning through approximately 360 degrees in each direction.

A unit may be employed in conjunction with the probe for response to its rotary movement, which unit may typically be resolver having a portion connected to the probe for rotation therewith, with the output of that unit being utilized to indicate the rotary positioning of the probe at the time that any particular signal is produced by the inclination and direction sensing means. A graph of the various output readings produced by the sensing elements may be developed, and will normally define a circle whose size indicates the extent of the offset in the sensing element or elements. The rotation of the probe may be effected by a unit responsive to vibratory movement of the device, or by a power driven motor or other appropriate means.

BRIEF DESCRIPTION OF THE DRAWING

The above and other features and objects of the invention will be better understood from the following detailed description of the typical embodiments illustrated in the accompanying drawing in which.

DESCRIPTION OF THE PREFERRED EMBODIMENTS

Figure 1:
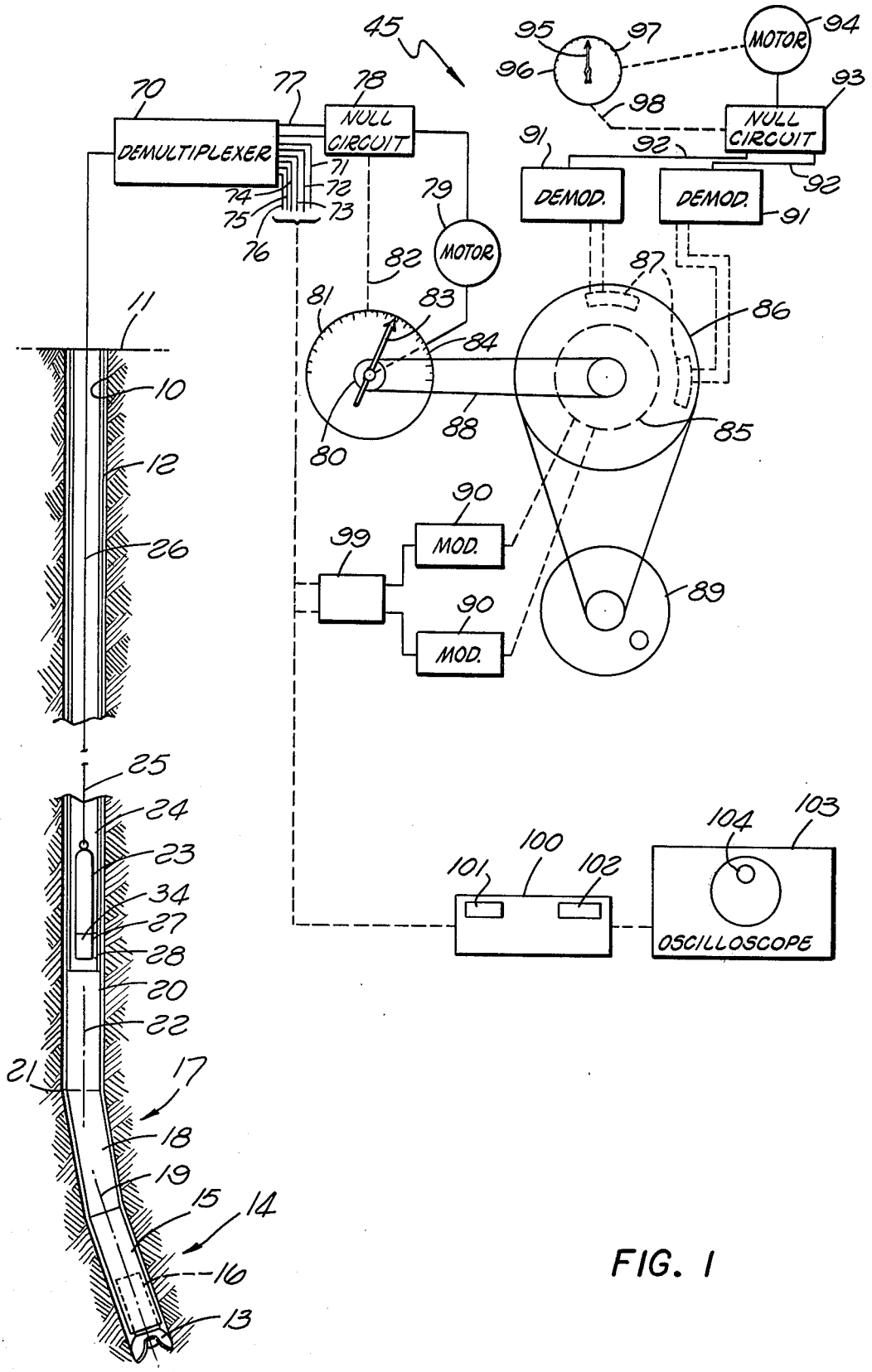
FIG. 1 is a diagrammatic representation of a well containing an instrument embodying the invention.

FIG. 1 shows a well 10 extending downwardly from the surface 11 of the earth and containing a drill string 12 having a rotary bit 13 at its lower end acting to drill the well bore. The drill string is typically illustrated as a non-rotating type string carrying a self-contained drilling unit 14 at its lower end having a non-rotating body 15 containing a motor 16 which drives the bit 13 rotatably. Above drilling unit 14, the drill string 12 may include a bent sub 17 having a lower portion 18 whose axis 19 is aligned with the axis of drilling unit 14 and its bit 13, and having an upper section 20 which is bent relative to lower section 18 at 21 so that the axis 22 of upper section 20 extends at a slight angle with respect to axis 19 to cause the bit to drill a laterally curving hole. An instrument 23 constructed in accordance with the present invention may be contained within a section 24 of pipe connected threadedly to the upper end of the bent sub 17 and preferably formed of a non-magnetic material such as monel metal to enable the instrument 23 to react to the earth's magnetic field. Pipe section 24 and the contained instrument 23 may have their longitudinal axis 25 aligned and coincident with axis 22 of the upper portion of the bent sub. A flexible electrically conductive insulated cable 26 may be utilized to lower instrument 23 into the well, and to conduct electrical signals upwardly from the instrument to the surface of the earth for indicating to an operator the inclination of the instrument 23 at a particular instant and the direction of that inclination. In 'steering' operations, instrument 23 may be fixed relative to the non-magnetic section 24 of pipe thereabout, and retained against rotation relative thereto, as by reception of a locating projection 28 carried by pipe section 24 or a sub secured thereto within a recess 27 in a mule shoe element 34 carried by the instrument.

While the instrument 23 is typically illustrated in FIG. 1 as utilized in conjunction with a bent sub and a non-rotating drill string and associated parts, the instrument may also be employed for surveying a well in which no drill string is present, or may be employed in a rotating type drill string.

Figure 2:
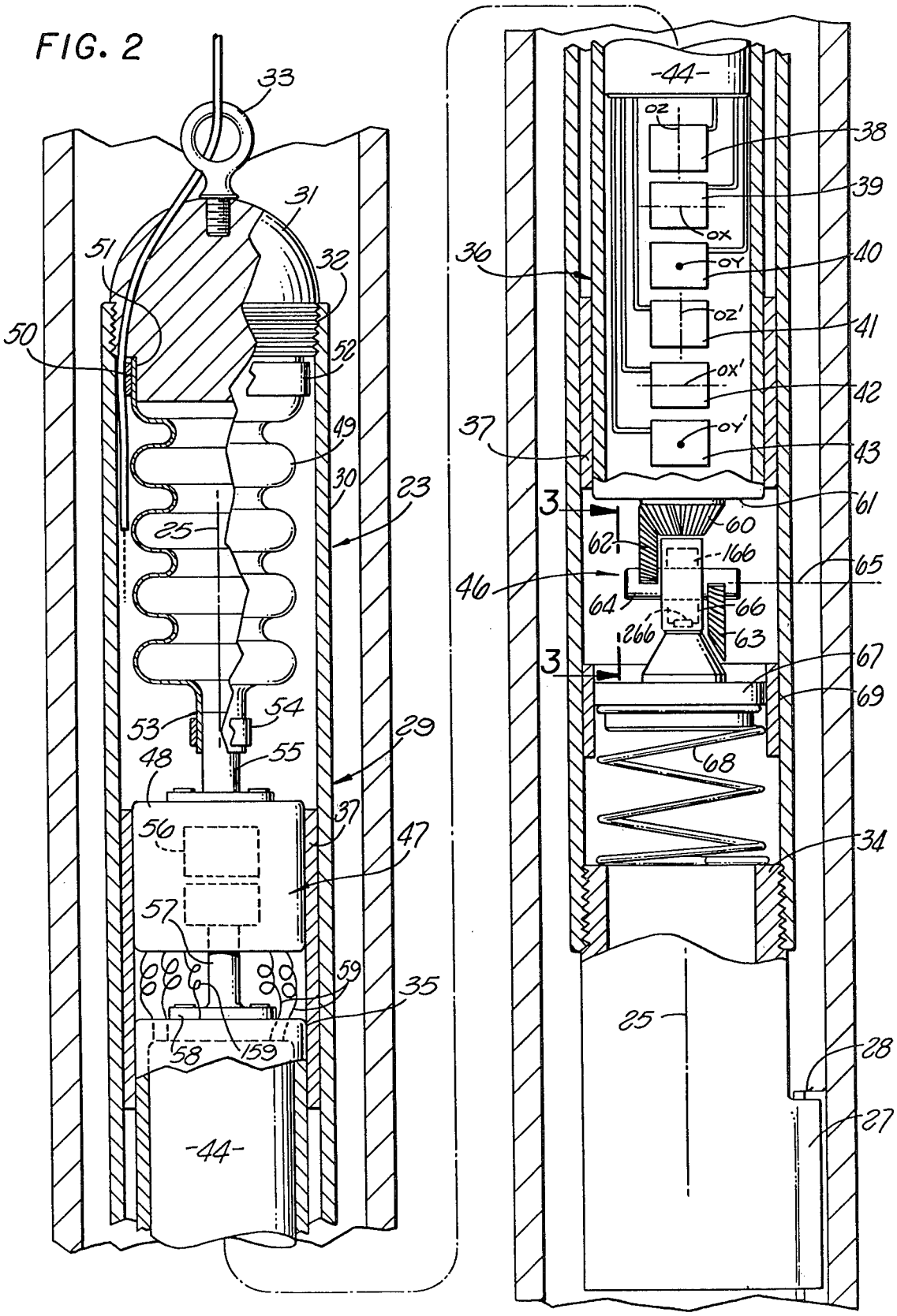
FIG. 2 is an enlarged view of the instrument, shown primarily in axial section.

Referring now to FIG. 2, the instrument 23 has a vertically elongated hollow fluid tight housing or body 29 whose cylindrical side wall 30 is centered about the longitudinal axis 25 of the instrument and the portion of the well within which the instrument is contained. The upper portion of body 29 may be closed and sealed by a top adapter 31 threadedly connected to the body at 32 and having a suspending eye or other element 33 by which the instrument is connected in any appropriate manner to cable 26 for suspension by the cable in the well. The lower end of body 29 may be closed by the mule shoe element 34.

Contained within body 29, the instrument 23 includes an elongated probe 35 which may be of a known construction adapted to respond to changes in the inclination of the instrument in the well and the direction of that inclination. More particularly, the probe may be of a general type disclosed in U.S. Pat. Nos. 3,791,043 and 3,862,499. The probe may have an externally cylindrical hollow case or body 36 which is appropriately mounted for rotation about axis 25 relative to outer body 29 by reception within sleeve bearings 37 secured to body 29 and closely rotatably receiving the probe case. Within case 36, probe 35 includes two or three gravity actuated sensing elements (three illustrated at 38, 39 and 40), and two or three direction responsive sensing elements (three illustrated at 41, 42 and 43). Sensors 38, 39 and 40 may typically be pendulum type units, pendulous strain gauges, or the like, each acting to develop an electrical signal corresponding to changes in the inclination of a corresponding axis of the particular sensor with respect to the vertical. The sensing axis OZ of one of these sensors (typically sensor 38) may coincide with the longitudinal axis 25 of the instrument, while the sensing axes OX and OY of the other two units 39 and 40 may extend perpendicular to axis OZ and the longitudinal axis 25 of the instrument and perpendicular to one another. The three units 38, 39 and 40 thus sense three components of the inclination of instrument 23 with respect to the vertical, and together can define that inclination precisely.

The three direction sensors 41, 42 and 43 similarly sense three different components of the earth's magnetic field, with respect to three axes OZ', OX' and OY' respectively. The axis OZ' may coincide with the previously mentioned axis OZ of inclination sensor 38, while the axes OX' and OY' may be parallel to axes OX and OY respectively. When only two sensors of each type are employed, the sensors 38 and 41 are usually omitted.

Electrical signals from each of the sensors 38 through 43 are delivered to an electronic unit 44 which is contained within housing 36 of the probe and which produces an electrical output in line 26 leading to the surface of the earth. This output includes signals corresponding to the inclination and direction components sensed by elements 38 through 43, with those signals being delivered to cable 26 in multiplex form for delivery to the surface equipment 45. Cable 26 may be a single conductor cable, with the second side of the circuit completed through ground or through the drill string, or may have an outer conductive armour portion completing the second side of the circuit.

In the instruments of the above mentioned prior U.S. Pat. Nos. 3,791,043 and 3,862,449, the sensing elements corresponding to sensors 38 through 43 of the present invention are fixed relative to the outer casing of the instrument, and produce individual component signals which vary in different rotary positions of the probe. These varying components can be summed at the surface of the earth, however, to arrive at an overall inclination and azimuth which theoretically remain constant regardless of the position to which the probe turns. In the present tool, the probe 35 which contains the sensors is purposely mounted to turn relative to outer body 29 about axis 25 so that any slight variations or offsets in the readouts during such rotation may be noted. This rotation is effected by provision in the instrument 23 of a rotator 46 which may be energized by vibrational movement of body 29 during a drilling operation. A resolver 47 above probe 35 may respond to such rotation of the probe and deliver signals to the surface of the earth indicative of the rotary position of the probe at any particular instant. Resolver 47 may be of any conventional construction, including a body or stator 48 which may be externally cylindrical and located within upper sleeve bearing 37 for limited movement along axis 25. The body 48 of the resolver may be retained against rotation by a non-rotating bellows 49 having its upper end 50 clamped annularly against a portion 51 of adapter 31 by a clamp 52. A tubular lower end portion 53 of the bellows may be secured by a clamp 54 to a shaft 55 projecting upwardly from and rigidly secured to stator body 48 of the resolver so that the bellows 49 acts to retain that body against rotation while permitting slight axial movement thereof. The rotor 56 of resolver 47 has its shaft 57 connected by a flange 58 to the case 36 of probe 35, so that the rotor of the resolver turns about axis 25 in correspondence with the rotation of the probe. The windings of the resolver are connected by conductors 59 to electronic circuit 44 in the probe, with those conductors being flexible and long enough to permit relative rotation of the probe and resolver body through at least 360 degrees. The resolver produces signals in lines 59 corresponding to the instantaneous angular position of rotor 56 relative to stator body 48, and thus corresponding to the relative rotary position of probe 35 with respect to case 36 of the instrument. The electrical data processing circuit 44 produces signals corresponding to or dependent upon these resolver produced signals in two of the channels of the multiplexed output delivered to the surface of the earth through cable 26. The wire or wires 159 between the probe and cable 26, like lines 59, are flexible enough and long enough to avoid interference with the rotation of the probe relative to case 29.

Figure 3:
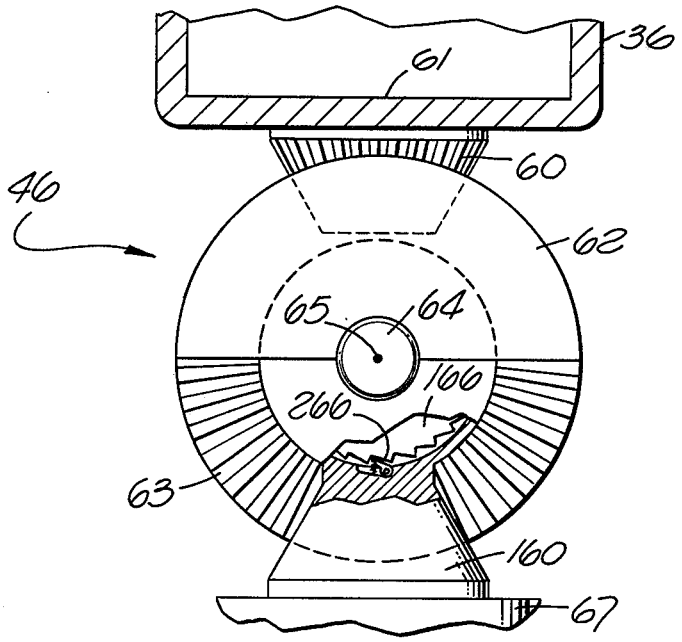
FIG. 3 is a fragmentary side view taken on line 3—3 of FIG. 2.

The rotator 46 may be of any type capable of responding to vibrational movement of case 36 either in an axial direction or torsional mode to rotate probe 35 relative to case 29 continuously. Preferably, the probe 35 is rotated alternately in opposite directions relative to case 29, desirably through 360 degrees first in one rotary direction and then through 360 degrees in the opposite rotary direction, etc. The particular rotator illustrated in FIGS. 2 and 3 is one responsive to vibrational movements in a torsional mode, and includes a bevel gear 60 secured rigidly to the transverse bottom wall 61 of case 36 and having its axis coincident with axis 25 of the instrument. For engagement with bevel gear 60, there are provided two semi-circular half bevel gears 62 and 63 which are desirably of a diameter twice that of gear 60 and are secured to a common shaft 64 whose axis 65 extends perpendicular to and intersects axis 25. Shaft 65 is mounted rotatably within a part 66 projecting upwardly from and rigidly secured to an annular element 67.

Element 67 is yieldingly urged upwardly by a coil spring 68 and mounted within a sleeve bearing 69 to turn about axis 25 and for limited movement along that axis. Part 66 is hollow and contains a one way clutch arrangement permitting rotation of shaft 64 in one direction about axis 65 but not in the opposite direction. For this purpose, the mentioned one way clutch may take the form of a ratchet wheel 166 fixed to and extending about shaft 64 and a spring pressed ratchet pawl 266 mounted pivotally to part 66 and engageable with ratchet wheel 166 to permit only the one way rotation as discussed. The two semi-circular partial bevel gears 62 and 63 are essentially complementary, so that when one of these gears is in engagement with gear 60 the other partial gear 62 or 63 is not, and vice versa. When gear 62 is in engagement with gear 60, the assembly will transmit rotary movement from parts 66 and 67 to case 36 about axis 25 in one direction, while rotary movement of parts 66 and 67 in the opposite direction about axis 25 merely results in rotation of shaft 64 in part 66 as permitted by the one way clutch ratchet mechanism. When gear 63 is in engagement with gear 60, the assembly will transmit rotation about axis 25 in the opposite direction. Rotary oscillation of part 66 about axis 25 relative to case 36 in response to torsional vibratory movement of the drill string thus causes partial gear 62 to first progressively turn gear 60 and the connected probe in one rotary direction through 360 degrees, after which gear 63 moves into engagement with gear 60 to similarly cause progressive step by step rotation of gear 60 and the connected probe case 36 about axis 25 through 360 degrees but in the reverse direction. The overall result is therefore to produce rotation of the probe alternately in opposite directions and through 360 degrees in each of those directions, and with the resolver 47 producing signals corresponding to the relative rotary positioning of the probe with respect to case 36.

The multiplexed signals delivered to the surface of the earth by cable 26, including the six signals from sensors 38 to 43 and two signals from resolver 47, are fed first to a demultiplexer 70 which delivers the signals from sensors 38 through 43 to six outputs 71, 72, 73, 74, 75 and 76, while the two signals taken from the output windings of resolver 47 are delivered through lines 77 to a null circuit 78 and controlled motor 79 acting to turn the rotor 80 of a surface resolver 81 in a manner causing the rotor 80 of that resolver to at all times follow precisely the rotary movement of shaft 57 of downhole resolver 47. The feedback signal from resolver 81 is fed back through a line represented at 82 to the null circuit 78 for comparison with the signals delivered to that circuit from the downhole resolver through lines 77 to cause the resolver 81 to follow the movements of the downhole resolver. A pointer 83 connected to the shaft of resolver rotor 80 thus indicates on a 360 degree annular scale 84 the rotary position of probe 35 relative to case 29.

For steering purposes, some of the demultiplexed signals in lines 71 through 76 corresponding to the inclination and direction components detected by sensors 38 through 43 in the probe may be delivered in modulated form to the rotor windings 85 of an additional resolver 86 at the surface of the earth, which functions as a rotary transformer for producing corresponding signals in the output windings 87 of resolver 86 representing the components sensed by the probe, with those components being altered in accordance with the relative rotary setting of the rotor and stator of resolver 86. The rotor of resolver 86 is connected mechanically to the rotor of resolver 81, to turn in correspondence therewith, with that mechanical connection being represented at 88 in FIG. 1. Thus, the rotor of resolver 86, like the rotor of resolver 81, is automatically turned to a position corresponding to the relative rotary setting of probe 35 in case 36, to introduce an automatic compensation into the output signals in stator windings 87 of resolver 86 acting to compensate for the rotation of the probe in the instrument. Resolver 86 may be initially set to a condition corresponding to a particular rotary setting of the probe relative to case 36 and the drill string by manually turning the stator 87 of resolver 86 by means of an actuating mechanism represented at 89.

The signals in lines 71 to 76 may be Direct Current analogue voltage signals, which are converted to A.C. signals by modulators 90, with the outputs from resolver 86 being converted back by demodulators 91 to D.C. analogue signals which are fed through lines 92 to a null circuit 93 and controlled motor 94. The motor turns the rotor and pointer 95 of a readout resolver 96 to a position indicating on a 360 degree scale 97 the resultant of the two signals in lines 92 from the demodulators. The feedback signal from the resolver is delivered through line 98 to the null circuit, where it is compared with the input from lines 92 to turn the pointer to a proper resultant position.

A selector switch 99 may determine which of the lines 71 to 76 are connected to modulators 90. In one condition of switch 99, it may deliver to the modulators signals from lines 72 and 73, representing the inclination components detected by gravity sensors 39 and 40 respectively. Resolver 86 then functions to alter those components to compensate for the rotary position of probe 35 in case 23 so that pointer 95 indicates the "high side" angle of the instrument, that is, the number of degrees through which the instrument and bent sub are turned from a position in which the bent sub is aimed toward the high side of the hole. In another condition of switch 99, lines 75 and 76 may be connected to modulators 90, to deliver thereto directional component signals controlled by magnetic sensors 42 and 43 respectively, so that the position of pointer 95 then indicates the resultant of those signals, corrected to compensate for rotation of the probe. The reading of pointer 95 therefore indicates the number of degrees through which the instrument and bent sub are turned from a position in which the bent sub is aimed to drill in a particular compass direction, say the magnetic north direction.

When the apparatus of the present invention is to be utilized for deriving survey information, as distinguished from the above discussed use in steering a drilling tool, the six analogue signals in lines 71 through 76 representing the inclination and direction components detected by sensors 38 through 43 respectively may be delivered to a readout unit 100 which can function in known manner to derive from these components the overall inclination of a hole and the azimuth of that inclination, and which can indicate that inclination and azimuth in digital form on indicators 101 and 102. The readout unit 100 can also indicate the various gravity and magnetic components individually if desired. The azimuth and the sine of the inclination can be plotted against one another on polar paper, and theoretically each of these values should remain constant in spite of the rotation of the probe in the instrument body. In actual practice, however, slight inaccuracies or offsets in the sensors and related equipment will cause the plotted points to define a small circle, indicating the amount of offset or error that there is in the equipment, with the center of the defined circle indicating inclination and azimuth values corrected for the offsets. Instead of manually plotting inclination against azimuth, signals developed by readout unit 100 and representing inclination and azimuth can be fed to an oscilloscope 103, which will plot a small circle 104 representing the variation in output resulting from the offsets in the equipment in the same manner as does the manually plotted circle described above. With the offsets known, an operator may compensate for the inaccuracies in calculating the results of the survey, or automatic computer equipment or other circuitry can be provided for introducing a correction into the readings automatically.

To briefly summarize the use and operation of the above described apparatus, assume that instrument 23 has been lowered to the FIG. 1 position within the illustrated non-rotating drill string, and that the instrument has been located relative to the drill string by mule shoe elements 27–28. The torsional vibration of the drill string caused by engagement of the drill bit with the earth formation then causes rotator 46 in the manner previously described to alternately turn probe 35 in opposite directions about axis 25 relative to case 36, and through 360 degrees in each direction. Resolver 47 produces output signals corresponding to and representing the rotary positioning of probe 35 within case 36, which signals are delivered in multiplexed fashion to the surface of the earth by cable 26, along with the similarly multiplexed outputs from sensors 38 through 43 representing three different components of the inclination of probe 35 and three different components of the direction of that inclination. The signals on cable 26 are demultiplexed at the surface of the earth by circuit 70, with the signals controlled by resolver 47 acting to cause surface resolver 81 to follow the movements of down hole resolver 47 exactly, and with the signals representing components of the inclination and its azimuth or direction being delivered to the rotor of the second surface resolver 86, which rotor is mechanically turned in exact correspondence with the rotation of the rotor of resolver 81. Resolver 86 functions as a rotary transformer, producing outputs in lines 92 corresponding to the sensor controlled inputs in rotor 85, but with alteration of the signals to compensate for the rotary position of probe 35 because rotor 85 of resolver 86 follows the downhole resolver 47 as discussed. The gravity or magnetic components are summed trigonometrically by resolver 96 in association with motor 94 and nulling circuit 93, to produce a reading on pointer 95 giving the direction in which the bent sub is aimed with respect to either the high side of the hole or Magnetic North. Alternate readings for survey purposes are given by readout 100 or oscilloscope 103 to indicate the inclination and azimuth of the hole or components thereof, with variations in the inclination and azimuth readings revealing the offsets or inaccuracies in the sensors and their related circuitry as discussed.

Figure 4:
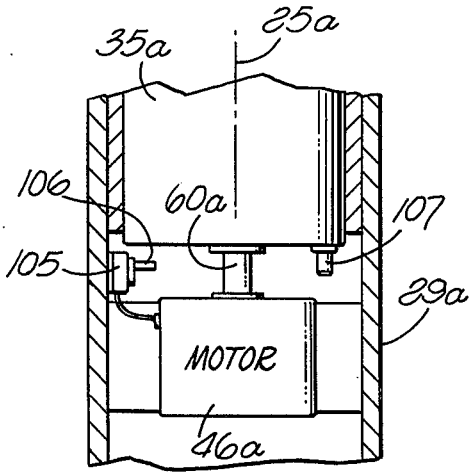
FIGS. 4 and 5 are fragmentary views similar to a portion of FIG. 2, but showing two variational arrangements.

As has been indicated previously, it is contemplated that the probe 35 may be rotated relative to case 36 by means other than the rotator 46 typically illustrated in FIG. 2. A rotator responsive to axial vibratory movements of the tool rather than torsional vibratory movements may be employed, or an electrically driven motor may be utilized as illustrated in FIG. 4. The motor **46*a* of that Figure may have its stator rigidly connected to case 29*a* of the tool, and may have its shaft 60*a* connected rigidly to the case of probe 35*a* to turn it about axis 25*a* of the instrument. A reversing switch 105 may be mounted to the case 29*a* of the instrument, and have its actuating arm 106 positioned for engagement with a pin 107 carried by and turning with probe 35*a*. Pin 107 may engage actuating arm 106 of switch 105 after rotation through 360 degrees in either direction about axis 25*a*, with the switch acting when thus contacted to reverse the power to motor 46*a* and cause that motor to turn its shaft and the probe in the opposite direction. Thus, motor 46*a* turns the probe alternately in opposite directions through 360 degrees to attain the same overall result as does rotator 46 of the first form of the invention. Except with regard to the manner of rotation of the probe, the tool of FIG. 4 and its related circuitry may be the same as has been described in connection with FIGS. 1 to 3**.

Figure 5:
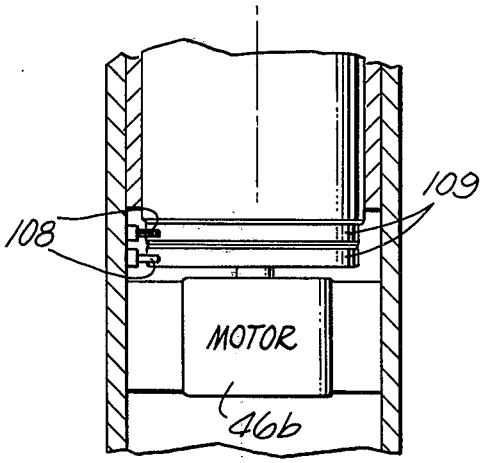

In the further variation of FIG. 5, motor **46*b* drives probe 35*b* continuously in a single direction, with the electrical connections to the probe being made through brushes 108 and slip rings 109**.

While certain specific embodiments of the present invention have been disclosed as typical, the invention is of course not limited to these particular forms, but rather is applicable broadly to all such variations as fall within the scope of the appended claims.

I claim:

1. A well instrument comprising:

a first body adapted to be lowered into a well;

a second body carried by said first body and lowerable therewith into a well and having an axis which extends longitudinally of the well;

a plurality of gravity sensors carried by said second body and operable to sense different components respectively of the earth's gravitational field from which the inclination of said axis can be derived;

a plurality of direction sensors carried by said second body and operable to sense different components respectively of direction from which the azimuth of said inclination can be derived; and means for turning said second body and said gravity and direction sensors relative to said first body about said axis.

2. A well instrument as recited in claim 1, in which said direction sensors are constructed to sense different components respectively of the earth's magnetic field.

3. A well instrument as recited in claim 1, in which said means for turning said second body are constructed to rotate the second body alternately in opposite directions about said axis.

4. A well instrument as recited in claim 1, in which said turning means include an element mounted for vibratory movement, and means for turning said second body about said axis relative to said first body in response to said vibratory movement of said element.

5. A well instrument as recited in claim 1, in which said turning means include an element mounted for vibration in a torsional mode, and means for turning said second body alternately in opposite directions about said axis relative to said first body in response to said torsional vibration.

6. A well instrument as recited in claim 1, in which said turning means include a first gear connected to one of said bodies and centered essentially about said axis, two partial gears connected to the other body for rotation relative thereto about a second axis extending essentially transversely of said first axis, and constructed and mounted so that during part of a revolution of said second body one of said partial gears but not the other engages said first gear, and during the remainder of a revolution said other partial gear but not said one partial gear engages said first gear, and a one way clutch permitting rotation of said partial gears in only one direction about said second axis in a relation rotating said second body alternately in opposite directions relative to said first body in response to oscillatory movement of said first body.

7. A well instrument as recited in claim 1, including means for indicating to an operator any changes in the output of said gravity and direction sensors resulting from said turning of said second body about said axis.

8. A well instrument as recited in claim 1, including a unit responsive to rotation of said second body relative to said first body, and means actuable by said unit to introduce a correction into the output of some of said sensors compensating for changes in the relative rotary positioning of said bodies.

9. A well instrument as recited in claim 1, including a resolver responsive to rotation of said second body relative to said first body about said axis, and means responsive to said resolver to introduce a correction into the output of said gravity sensors compensating for changes in the relative rotary positioning of said bodies.

10. A well instrument as recited in claim 1, including a resolver having two relatively rotatable sections, means connecting a first of said sections of the resolver to said first body and holding said first section against rotation relative to said first body, the second of said sections of the resolver being connected to said second body to turn therewith about said axis.

11. A well instrument as recited in claim 10, including a second resolver at the surface of the earth receiving signals controlled by the relative rotary setting of said sections of said first resolver, means for driving said second resolver to follow the setting of said first resolver, a third resolver connected to said second resolver to follow the setting thereof, said third resolver having input coils receiving signals from some of said sensors and having output coils which deliver output signals corrected to compensate for the relative rotary positioning of said sections of the first resolver.

12. A well instrument as recited in claim 1, including a spring carried by said first body at a location beneath the second body and supporting the second body relative to said first body.

13. A well instrument as recited in claim 1, including a spring carried by said first body at a location beneath said second body and supporting the second body relative to said first body, said turning means being interposed vertically between said spring and said second body and acting to turn the second body alternately in opposite directions in response to vibratory movement.

14. A well instrument as recited in claim 1, including a resolver having two relatively rotatable sections, a bellows connecting a first of said sections to said first body and preventing rotation of said first section of the resolver relative to said first body, the second section of said resolver being connected to said second body for rotation therewith.

15. A well instrument as recited in claim 14, including a support spring beneath the second body, said turning means being interposed vertically between said support spring and said second body and including gears acting to alternately turn said second body and said second section of the resolver aout said axis in opposite directions in response to vibratory forces in a torsional mode.

16. A well instrument as recited in claim 1, including readout means at the surface of the earth responsive to said gravity and direction sensors to derive representations of the overall inclination of said axis and the azimuth of that inclination from said components, with variations in the inclination and azimuth resulting from rotation of said second body and said sensors indicating inaccuracies in the instrument.

17. A well instrument comprising:

a body adapted to be lowered into a well;

a probe carried by said body and lowerable therewith into a well and having an axis which extends longitudinally of the well;

said probe including gravity and direction sensors responsive to changes in the inclination of said axis of the probe and in the azimuth of that inclination and operable to produce outputs from which said inclination and azimuth can be derived regardless of the position to which said probe is rotated about said axis; and means for turning said probe relative to said body about said axis so that variations in the derived inclination and azimuth will indicate inaccuracies in the instrument.

18. A well instrument as recited in claim 17, including readout means responsive to said sensors to derive representations of the overall inclination of said axis and the azimuth of that inclination, with variations in inclination and azimuth resulting from rotation of said probe about said axis indicating inaccuracies in the instrument.

19. A well instrument as recited in claim 17, including a unit responsive to rotation of said probe relative to said body, and means responsive to said unit to introduce a correction into outputs from said sensors compensating for said rotation of the probe about said axis.

20. The method comprising:

lowering into a well a probe having sensing means responsive to changes in inclination of an axis of the probe or the direction of that inclination;

rotating said probe about said axis;

taking different readings from said probe in different rotary positions thereof; and determining the accuracy of said sensing means by noting variations in said readings.

21. The method as recited in claim 20, including rotating said probe alternately in opposite directions about said axis.

22. The method as recited in claim 20, including rotating said probe alternately in opposite directions about said axis through approximately 360 degrees.

23. The method as recited in claim 20, including rotating said probe continuously in one direction about said axis.

* * * * *